United States Patent [19]

Boykin et al.

[11] 4,187,977

[45] Feb. 12, 1980

[54] TWO PIECE PRODUCE BOX

[75] Inventors: Richard A. Boykin, Virginia Beach; Gordon A. Hamilton, Highland Springs, both of Va.

[73] Assignee: Champion International Corporation, Stamford, Conn.

[21] Appl. No.: 921,747

[22] Filed: Jul. 3, 1978

[51] Int. Cl.[2] ..... B65D 5/64; B65D 43/04

[52] U.S. Cl. ..... 229/43; 229/16 C; 229/32

[58] Field of Search ..... 229/16 C, 43, 45, 25, 229/26, 32

[56] References Cited

U.S. PATENT DOCUMENTS

| | | | |
|---|---|---|---|
| 317,997 | 5/1885 | Hollett | 229/25 |
| 999,764 | 8/1911 | Eklund et al. | 229/16 C UX |
| 1,234,634 | 7/1917 | Craven | 229/43 |
| 1,597,065 | 8/1926 | Davis | 229/16 C X |
| 1,702,945 | 2/1929 | Meisner | 229/16 C |
| 1,946,554 | 2/1934 | Sutherland | 229/43 X |
| 1,954,201 | 4/1934 | Goodyear | 229/32 X |
| 2,399,604 | 4/1946 | Schoenberger | 229/25 |
| 3,447,672 | 6/1969 | Bailey et al. | 229/16 C X |
| 3,486,680 | 12/1969 | Negus, Jr. | 229/32 |
| 3,986,659 | 10/1976 | Vajtay | 229/43 |

FOREIGN PATENT DOCUMENTS

| | | | |
|---|---|---|---|
| 2248980 | 5/1975 | France | 229/43 |

*Primary Examiner*—Davis T. Moorhead
*Attorney, Agent, or Firm*—Evelyn M. Sommer

[57] ABSTRACT

In a two piece box having a base tray with a bottom panel, side walls and end walls and an attaching lid, the improvement comprising at least one slot in each said end wall, at least one recess in the upper edge of each of said side walls, and a generally rectangular lid comprising at least one extension finger projecting from each end of said lid for insertion in a corresponding one of said slots in said end walls of said base tray, and at least one T-shaped projection extending horizontally from each side of said lid for insertion in a corresponding one of said recesses in each said side wall of said base tray whereby said lid is removably locked in place in said base tray.

5 Claims, 6 Drawing Figures

TWO PIECE PRODUCE BOX

BACKGROUND OF THE INVENTION

The present invention relates to a two piece, die cut, corrugated, three pound produce box with a separate recessed top locking lid. Such two piece boxes are necessary for the transportation and storage of produce such as mushrooms and the like. The boxes are normally shaped to allow nesting or stacking in such a way as to minimize the use of space. The boxes usually have a base length of approximately 11⅝ inches, a top length of approximately 13 3/16 inches, and a width of approximately 5 9/16 inches at the top and 4½ inches at the bottom. The boxes are usually ventilated with some type of orifice to allow air circulation to maintain the produce in a fresh condition.

The prior art boxes of this type are manufactured and shipped set up in nested stacks which, of course, require considerable shipping and storage space. Further, the lid on the prior art box is supported by and held in place on the bottom tray by a precision cut plastic strap handle. The handle, of course, increases the cost of the carton by the additional cost of the handle material and the labor or assembly costs necessary to attach the handle. Further, when the product is packed in the cartons, and they are stacked during handling, storing, and shipping, the produce is easily crushed because of the weight of the other cartons on top of the stack.

The present invention is an improvement on the construction of such cartons as taught in the prior art by providing a two piece die cut corrugated product box wherein the containers can be bundled and shipped as blanks thereby requiring considerably less shipping and storage space and a corresponding reduction in freight costs per unit, that do not require handles and thus eliminate the handle cost and labor or assembly costs associated therewith and which has a lid design allowing the lid to snap into place quickly and which provides greater protection against damage of the product from exterior crush during handling and stacking.

SUMMARY OF THE INVENTION

The present invention overcomes the problems of the prior art and provides a two piece box that can be bundled and shipped as blanks and therefore in a flat condition thus affording a reduction in freight costs per unit and are so constructed as to eliminate the handle costs and labor or assembly costs of attaching a handle and yet provides a lid design that snaps into place quickly and is more secure than the plastic, strap-controlled lid. Further, the redesigned lid provides greater support in protecting the product against damage from exterior crush during handling, shipping and stacking.

Briefly stated, the invention relates to a two piece box having a base tray with a bottom panel, side walls and end walls and an attaching lid, at least one slot in each said end wall, at least one recess in the upper edge of each said side wall, and a generally rectangular lid for cooperating with said slots and said recesses such that said lid removably locks in place in said base tray.

The invention further relates to a pair of blanks for forming a two piece box comprising a top lid blank comprising a generally rectangular panel, at least one extension finger projecting from each end of said panel, and at least one T-shaped projection extending horizontally from each side of said rectangular panel and a base tray blank comprising a rectangular bottom panel, first and second trapezoidal side walls integrally formed with and hingedly attached to the sides of said bottom panel, first and second trapezoidal end walls integrally formed with and hingedly attached to the respective ends of said bottom panel, at least one recess in the upper edge of each of said side walls for receiving the T-shaped projection extending from said lid when said blank is folded to form a carton, first and second lid locking flaps integrally formed with and hingedly attached to the ends of said first side wall, third and fourth lid locking flaps integrally formed with and hingedly attached to the ends of said second side wall, and at least one slot in each said lid locking flaps for receiving a corresponding one of said extension fingers projecting from each end of said lid when said carton blank is folded whereby said slot and said recesses removably lock said lid to said carton.

BRIEF DESCRIPTION OF THE DRAWINGS

These and other objects and advantages of the present invention will be disclosed in the course of the following specification, reference being had to the accompanying drawings in which.

DESCRIPTION OF THE PREFERRED EMBODIMENT

The two piece produce box is designed to carry approximately three pounds of produce such as mushrooms or the like and is usually made from die cut corrugated cardboard. Obviously any type of material sufficient for carrying a load equivalent to approximately three pounds could be used. The box includes a base tray with a bottom panel, side walls and end walls comprising at least one slot in each said end walls and at least one recess in the upper edge of each said side wall. The end walls and side walls are trapezoidal in shape with the narrow end of the trapezoid integrally formed with and hingedly attached to the bottom of the base tray whereby the perimeter of the top of the assembled tray is larger than the perimeter of the bottom thereof. Each end wall comprises an outer trapezoidal panel integrally formed with and hingedly attached to the bottom panel of the base tray and an inner lid locking panel having at least one slot therein. The inner lid locking panel comprises first and second flaps each integrally formed with and hingedly attached to a corresponding one of the side walls whereby the flaps may be folded inwardly and attached to the outer trapezoidal panel to form an end wall. At least one slot is located in each of said flaps and those slots are recessed approximately one quarter inch from the top of the base tray.

A generally rectangular lid cooperates with the slots and the recesses such that the lid is removably locked in place in the base tray. The lid has at least one extension finger projecting from each end thereof for insertion in a corresponding one of the slots in the end walls of said base tray and also has at least one T-shaped projection extending horizontally from each side of said lid for insertion in a corresponding one of said recesses in each side wall of said base tray. When the lid is removably locked in said base tray, not only are the extension fingers on each end thereof inserted in a corresponding one of said slots in said end walls of said base tray, but also the leg of each of the T-shaped projections is inserted in a corresponding recess in the base tray side walls whereby the side wall of the base tray is interposed between the top of said T-shaped projection and the body of said lid.

Figure 1:
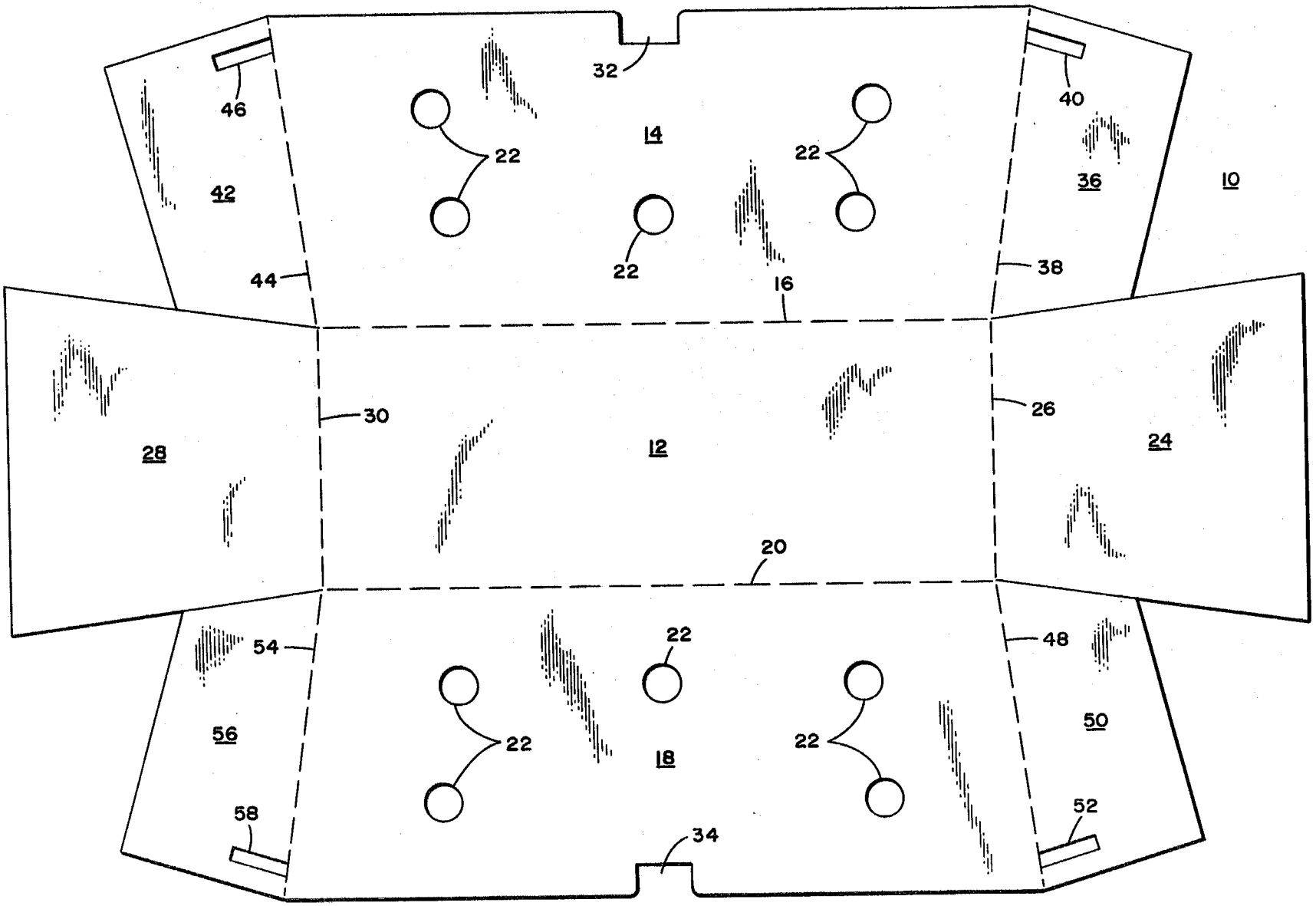
FIG. 1 is a plan view of a base tray blank for a two piece box illustrating the manner in which the component parts thereof are integrally formed with and hingedly attached to each other.

FIG. 1 is a plan view of the blank used to form the base tray of the two piece mushroom box. The blank itself is generally represented by the numeral 10 and comprises a rectangular bottom panel 12, a first trapezoidal side wall 14 integrally formed with and hingedly attached to said rectangular bottom panel 12 along line of articulation 16. A second trapezoidal side wall 18 is integrally formed with and hingedly attached to the other side of rectangular bottom panel 12 along articulation line 20. Each of said trapezoidal side walls has a plurality of orifices 22 therein which assist in providing proper ventilation and air flow to assist in maintaining any produce therein in a fresh state and to retard spoilage thereof.

Attached at one of said rectangular bottom panel 12 is a first trapezoidal end wall 24 which is integrally formed with and hingedly attached to said rectangular bottom panel 12 along line of articulation 26. Attached to the other end of rectangular bottom panel 12 is a second trapezoidal end wall 28 which is integrally formed with and hingedly attached to said rectangular bottom panel 12 along line of articulation 30.

A first recess 32 is formed in the top of said first trapezoidal side wall 14 and a second recess 34 is formed in the top of said second trapezoidal side wall 18. While only one such recess is shown, a plurality of recesses could be formed in said trapezoidal side wall panels 14 and 18 if desired. These recesses are used to hold the lid in a locked position with respect to the base tray as will be discussed hereinafter with respect to FIGS. 5 and 6. Also integrally formed with and hingedly attached to one end of said first trapezoidal side wall 14 along line of articulation 38 is a first inner lid locking flap 36. Cut in first inner lid locking panel 36 is a slot 40 which is recessed from the top edge thereof by a desired amount, usually one-quarter inch. Integrally formed with and hingedly attached to the other end of first trapezoidal side wall 14 is a second inner lid locking flap 42 attached along articulation line 44 and also having therein a slot 46 which is recessed from the top thereof in an amount equal to the distance slot 40 is recessed. Integrally formed with and hingedly attached to second trapezoidal side wall 18 along line of articulation 48 is a third inner lid locking flap 50. It also has a slot 52 formed therein and recessed a distance from the top equal to the distance slots 40 and 46 are recessed from the top. Integrally formed with and hingedly attached to the other end of second trapezoidal side wall 18 along line of articulation 54 is a fourth inner lid locking flap 56 having therein a slot 58 also recessed from the top thereof in amounts equal to the distance slots 40, 46 and 52 are recessed from the top.

Figure 2:
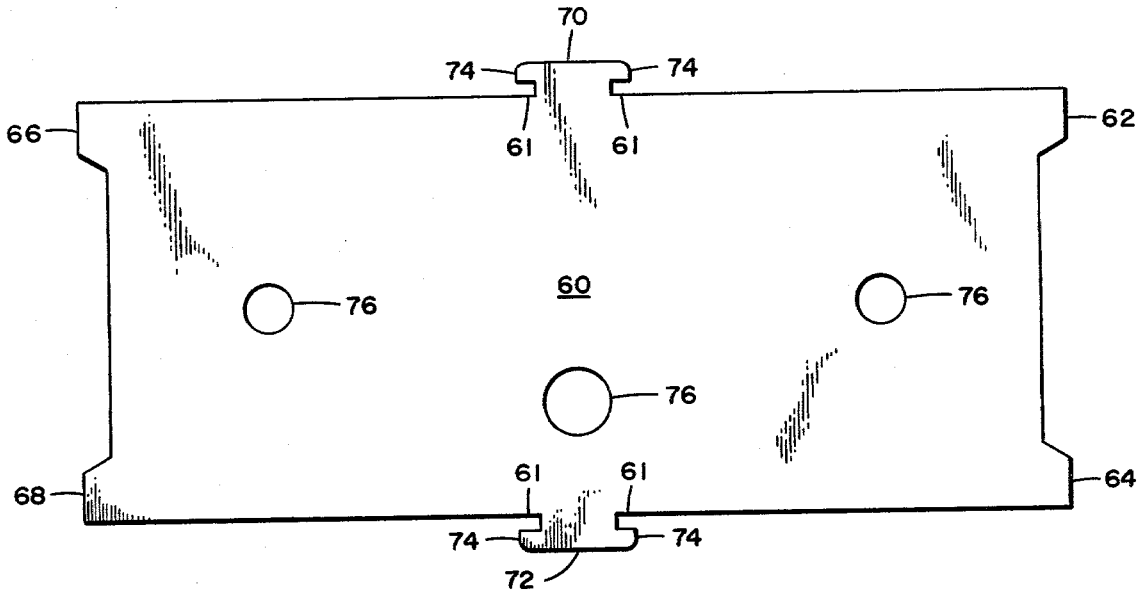
FIG. 2 is a plan view of a locking lid blank for a two piece box illustrating the manner in which the side projections and end extensions for locking said lid to the base tray are formed.

FIG. 2 is a plan view of the blank which forms the top locking lid for the two piece produce box. As can be seen, the lid 60 is generally rectangular in shape and has extension fingers 62 and 64 projecting from one end thereof and extension fingers 66 and 68 projecting from the other end thereof. T-shaped projections 70 and 72 extend horizontally from each side of said lid 60 and are adapted to be inserted in the corresponding recesses on the top edges of the base tray whereby the side wall 14 or 18 of the base tray is interposed between the top 74 of each of the T-shaped projections and the body 76 of said lid 60. Extension fingers 62, 64, 66 and 68 are designed to be inserted in a corresponding one of said slots 40, 46, 52 and 58 of the inner lid locking flaps 36, 42, 50 and 56 of the base tray. Also incorporated in lid 60 is a plurality of orifices 76 which provide ventilation and circulation for air in order to keep the produce fresh during shipping, storing and handling.

Figure 3:
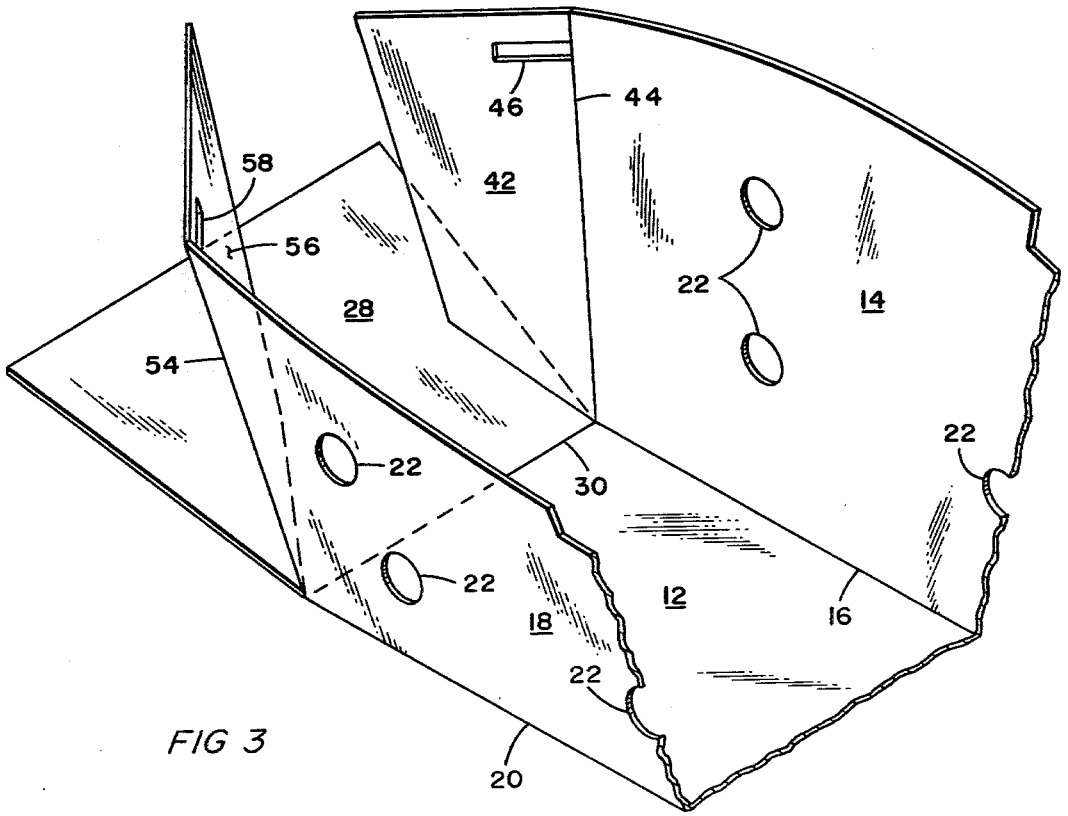
FIG. 3 is a partial perspective view of the base tray of a two piece box in its partially folded condition showing the manner in which the outer trapezoidal end wall panel and the inner lid locking end wall panel are related to the side wall and the bottom panel of said base tray.

FIG. 3 is a partial perspective view of the base tray in its partially assembled construction. It can be seen that second and fourth inner lid locking flaps 42 and 56 respectively are integrally formed with and hingedly attached to side wall panels 14 and 18 along lines of articulation 44 and 54 respectively. Slots 46 and 58 can also be seen in second and fourth lid locking panels 42 and 56 respectively. It will be noted that second and fourth inner lid locking panels 42 and 56 are folded inwardly about lines of articulation 44 and 56 respectively and then second trapezoidal end wall 28 is folded upwardly about articulation line 30 to form the outer end wall of the base tray. Second and fourth inner lid locking flaps 42 and 56 can be attached to outer trapezoidal panel 28 in any well known manner such as glueing or stapling to close the end of said base tray but it is preferably closed with the use of a post stitcher or any similar manual box stitcher.

Figure 4:
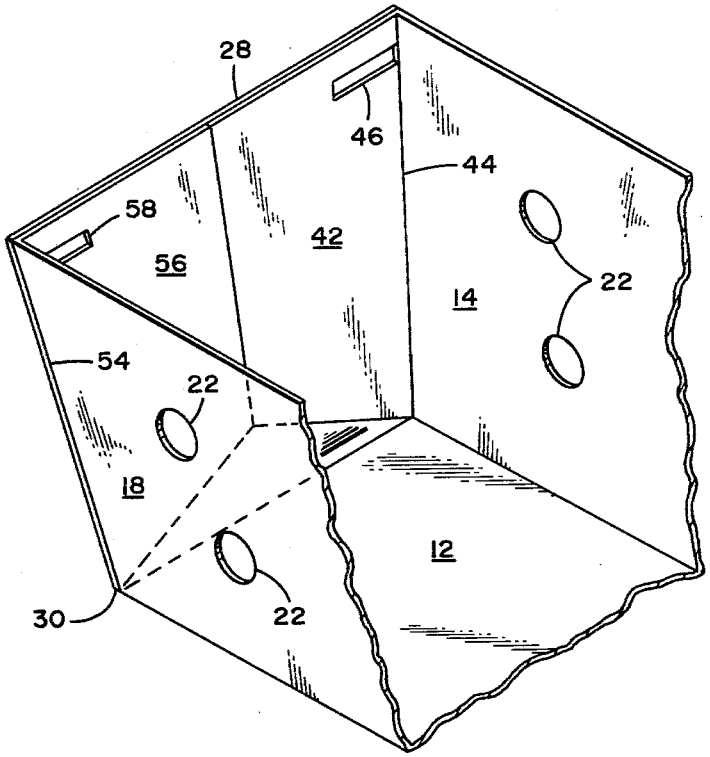
FIG. 4 is a partial perspective view of the base tray in its assembled condition illustrating the relationship of the outer trapezoidal panel and the inner lid locking panel which form the end wall of the base tray.

FIG. 4 is a partial perspective view of the base tray in its fully assembled state and illustrate the manner in which the second and fourth inner lid locking flaps 42 and 56 are in abutting relationship with and attached to second outer trapezoidal end wall 28. Also illustrated are slots 46 and 58 in second and fourth inner lid locking flaps 42 and 56 which are adapted to receive extension fingers 66 and 68 respectively of the locking lid 60 shown in FIG. 2.

Figure 5:
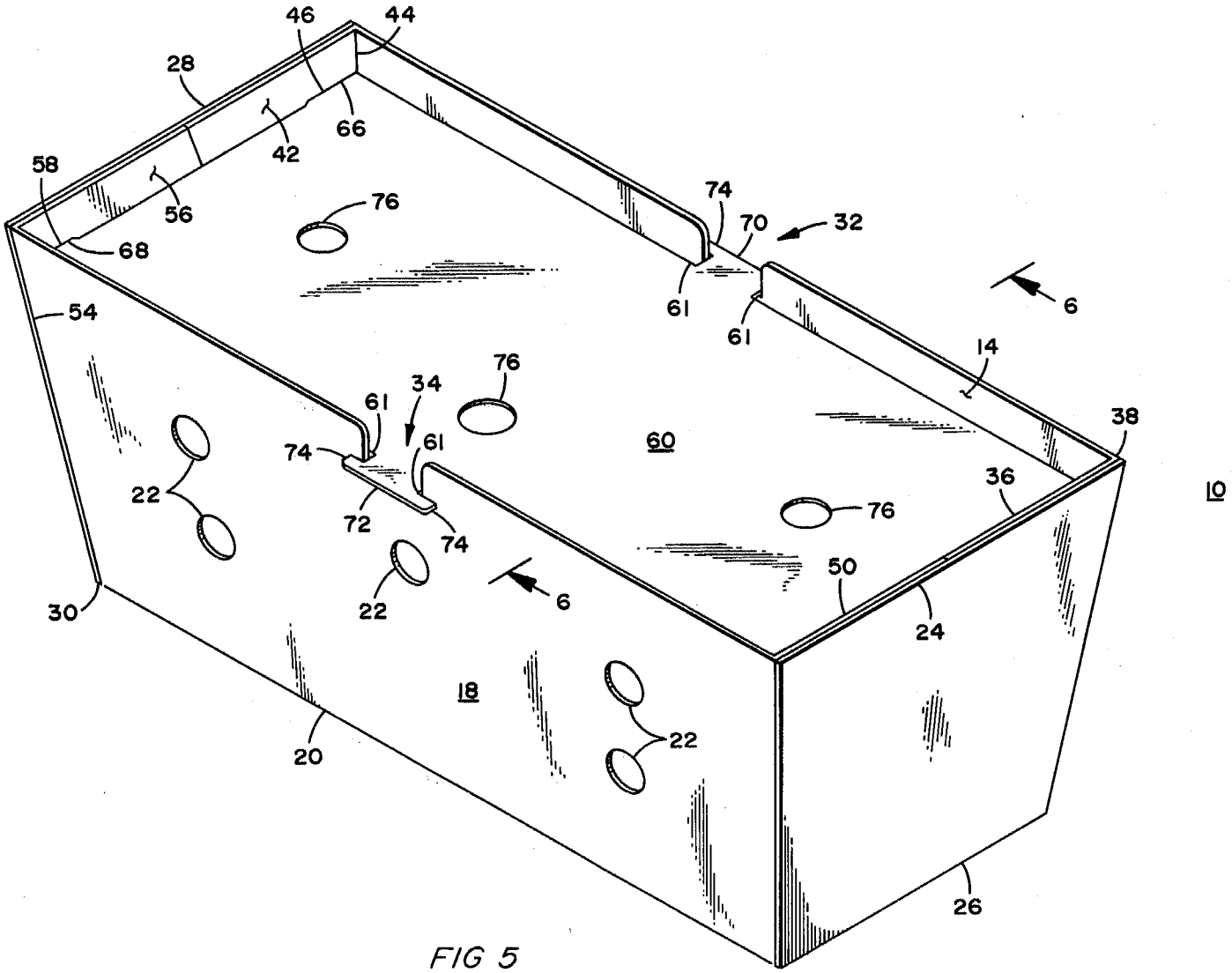
FIG. 5 is a perspective view of the two piece box in its assembled condition with the lid locked in place in said base tray.

FIG. 5 is a perspective view of the two piece produce box in its assembled state with lid 60 locked in place in the assembled base tray. It can be seen that extension fingers 66 and 68 of top lid 60 are inserted in slots 46 and 58 respectively of second and fourth inner lid locking flaps 42 and 56. Likewise, on the opposite end, not shown, extension fingers 62 and 64 would be inserted in slots 40 and 52 respectively of first and third inner lid locking flaps 36 and 50. It can also be seen that the T-shaped projections 70 and 72 are inserted in corresponding recesses 32 and 34 respectively in first and second trapezoidal side walls 14 and 18. The side wall of the base tray is interposed between the top 74 of each of said T-shaped projections and the body 61 of said lid 60.

Figure 6:
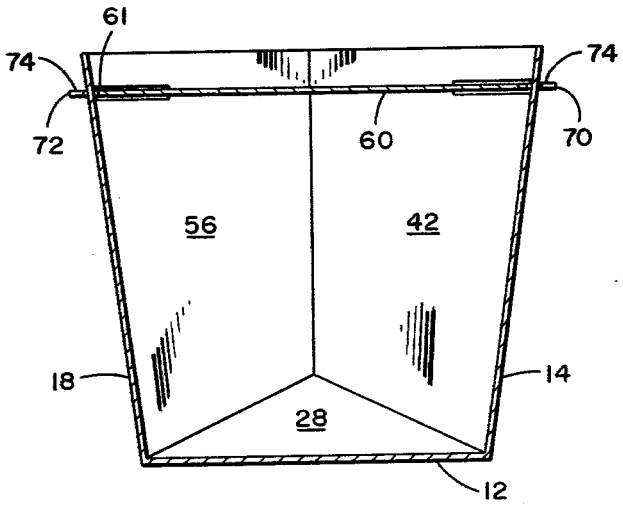
FIG. 6 is a sectional view of the closed container taken along lines 6—6 in FIG. 5.

The manner in which said recesses 32 and 34 hold T-shaped projections 70 and 72 inserted therein in a locking position can thus be seen in FIG. 6. The width of lid 60 is made slightly smaller than the width of the container base tray at the top thereof. When the lid is installed or locked in place in the base tray, the sides of the base tray are slightly squeezed together to allow the side walls 14 and 18 in the area of recesses 32 and 34 to be interposed between the top 74 of T-shaped projections 70 and 72 and the top lid body 61 and when the side walls 14 and 18 are released they apply pressure against the top 74 of the T-shaped projections 70 and 72 and thus hold them firmly in place and prevent the top 60 from slipping off the tray. Thus, the lid is easily and quickly snapped in place and remains locked until pressure is applied to the side walls 14 and 18 of the base tray thus allowing top lid 60 to be easily slipped out of the recesses and the corresponding slots in the end walls and removed.

Thus there has been disclosed a two piece produce box for items such as mushrooms which includes a nesting style base tray with a separate recessed top locking lid. The lid is recessed approximately one-quarter inch down from the top edge of the tray and is thereby locked into place by the four slots, the recesses and the T-shaped projections extending horizontally from the sides of the top 60. The lid of this type two piece box affords bridging strength and crush protection to the fruit or vegetables contained therein whenever they are palletized or stacked during storage and shipment. Further, the end wall panels form double wall construction and when stitched or otherwise attached to each other provide warpage control while supporting the locking function of the lid.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A two piece produce box comprising:

a base tray having a generally rectangular bottom panel and upstanding end walls and side walls, said end walls and said side walls being trapezoidal in shape with the narrow end of each trapezoidal wall being at the bottom of said base tray such that the perimeter of the top of said tray is larger than the perimeter of the bottom thereof, each said end wall having a pair of spaced slots therein adjacent the top edge thereof while each side wall includes a central recess in the top edge thereof and a generally rectangular lid of smaller width than the width of the base tray at the top thereof, said lid having two spaced extension fingers projecting from each end thereof for insertion into a corresponding pair of slots in each end wall of said base tray, said rectangular lid further including a central T-shaped projection extending horizontally from each side thereof for engagement with a corresponding one of said recesses in each side wall of said base tray whereby when said lid is removably locked in place in said base tray, with said T-shaped projections engaged in said recesses, the sides of the base tray apply pressure against the top of said T-shaped projections to hold said projections and the lid in place, and said T-shaped projections also function to support the intermediate span of the lid against collapse.

2. A two piece box as in claim 1 wherein each of said end walls comprises:

(a) an outer trapezoidal panel integrally formed with and hingedly attached to the bottom panel of said base tray, and (b) an inner lid locking panel having said spaced slots therein for receiving said extension fingers projecting from the end of said lid.

3. A two piece box as in claim 2 wherein said inner lid locking panel comprises:

(a) first and second flaps each integrally formed with and hingedly attached to a corresponding one of said side walls whereby said flaps may be folded inwardly and attached to said outer trapezoidal panel to form an end wall, and (b) at least one slot in each of said flaps for receiving a corresponding one of said extension fingers projecting from the end of said lid.

4. A two piece box as in claim 1 wherein:

(a) the leg of each said T-shaped projection is inserted in a corresponding one of said recesses whereby the side wall of said box is interposed between the top of said T-shaped projection and the body of said lid.

5. A two piece box as in claim 4 wherein:

(a) said lid is recessed in said base tray approximately one-quarter inch from the top.

* * * * *

UNITED STATES PATENT AND TRADEMARK OFFICE

CERTIFICATE OF CORRECTION

PATENT NO. : 4,187,977

DATED : February 12, 1980

INVENTOR(S) : Richard A. Boykin and Gordon A. Hamilton

It is certified that error appears in the above-identified patent and that said Letters Patent are hereby corrected as shown below:

In Column 1, line 32, delete "product" and insert in lieu thereof -- produce --.

In Column 3, line 39, insert the word -- end -- after the word "one".

In column 5, line 14, insert the word -- base -- before the word "tray".

Signed and Sealed this

*Twenty-second* Day of *July 1980*

[SEAL]

*Attest:*

SIDNEY A. DIAMOND

*Attesting Officer*

*Commissioner of Patents and Trademarks*